US008621870B2

(12) United States Patent
Carroni et al.

(10) Patent No.: US 8,621,870 B2
(45) Date of Patent: Jan. 7, 2014

(54) FUEL INJECTION METHOD

(75) Inventors: Richard Carroni, Niederrohrdorf (CH); Adnan Eroglu, Untersiggenthal (CH)

(73) Assignee: Alstom Technology Ltd., Baden (CH)

( * ) Notice: Subject to any disclaimer, the term of this patent is extended or adjusted under 35 U.S.C. 154(b) by 135 days.

(21) Appl. No.: 12/816,112

(22) Filed: Jun. 15, 2010

(65) Prior Publication Data

US 2010/0300109 A1 Dec. 2, 2010

Related U.S. Application Data

(63) Continuation of application No. PCT/EP2008/067581, filed on Dec. 16, 2008.

(30) Foreign Application Priority Data

Dec. 19, 2007 (EP) ..... 07150153

(51) Int. Cl.
*F02C 7/22* (2006.01)
*F02C 7/26* (2006.01)

(52) U.S. Cl.
USPC ..... 60/776; 60/225; 60/733; 60/39.17; 60/796; 60/800

(58) Field of Classification Search
USPC ..... 60/796, 225, 733, 39.17, 776, 800
See application file for complete search history.

(56) References Cited

U.S. PATENT DOCUMENTS 5,487,659 A 1/1996 Eroglu et al.
5,588,826 A * 12/1996 Dobbeling et al. ..... 431/354
5,626,017 A 5/1997 Sattelmayer
6,378,310 B1 4/2002 Le Gal et al.
6,702,574 B1 3/2004 Dobbeling
(Continued)

FOREIGN PATENT DOCUMENTS

DE 19859829 A1 6/2000
EP 0638769 A2 2/1995
EP 0933594 A 8/1999
WO 2006042796 A 4/2006
WO 2006058843 A 6/2006
WO 2007074033 A 7/2007
WO 2007113074 A1 10/2007

OTHER PUBLICATIONS

Jouis Jurgen, Kok Jim, Klein Slikke "Modeling and measurement of a 16Kw turbulent nonadiabatic syngas diffusion flame in a cooled cylindrical combustion chamber," Combustion and Flame, [online] 2001, XP002480121 http://cat.inist.fr/?aModele=afficheN&cpsidt=965116 [retrieved on Apr. 13, 2008].

*Primary Examiner* — Phutthiwat Wongwian
*Assistant Examiner* — Craig Kim
(74) *Attorney, Agent, or Firm* — Buchanan Ingersoll & Rooney PC

(57) ABSTRACT

A method is provided for fuel injection in a sequential combustion system comprising a first combustion chamber and downstream thereof a second combustion chamber, in between which at least one vortex generator is located, as well as a premixing chamber having a longitudinal axis downstream of the vortex generator, and a fuel lance having a vertical portion and a horizontal portion, being located within said premixing chamber. The fuel injected is an MBtu-fuel. In said premixing chamber the fuel and a gas contained in an oxidizing stream coming from the first combustion chamber are premixed to a combustible mixture. The fuel is injected in such a way that the residence time of the fuel in the premixing chamber is reduced in comparison with a radial injection of the fuel from the horizontal portion of the fuel lance.

20 Claims, 5 Drawing Sheets

(56) References Cited

U.S. PATENT DOCUMENTS

| | | | | |
|---|---|---|---|---|
| 7,568,335 | B2 * | 8/2009 | Althaus | 60/39.17 |
| 7,610,761 | B2 * | 11/2009 | Carroni et al. | 60/777 |
| 7,934,381 | B2 * | 5/2011 | Eroglu et al. | 60/740 |
| 2007/0207431 | A1 | 9/2007 | Oomens et al. | |
| 2008/0280239 | A1 | 11/2008 | Carroni et al. | |
| 2008/0314045 | A1 | 12/2008 | Carroni et al. | |
| 2009/0044539 | A1 | 2/2009 | Eroglu et al. | |

* cited by examiner

FUEL INJECTION METHOD

CROSS REFERENCE TO RELATED APPLICATION

This application is a continuation of International Application No. PCT/EP2008/067581 filed Dec. 16, 2008, which claims priority to European Patent Application No. 07150153.0, filed Dec. 19, 2007, the entire contents of all of which are incorporated by reference as if fully set forth.

FIELD OF INVENTION

The present invention concerns the field of combustion technology. A method is proposed, whereby MBtu fuels with highly reactive components can be safely and cleanly burned in a sequential reheat burner, as found e.g. in a gas turbine.

BACKGROUND

In standard gas turbines, the higher turbine inlet temperature required for increased efficiency results in higher emission levels and increased material and life cycle costs. This problem is overcome with the sequential combustion cycle. The compressor delivers nearly double the pressure ratio of a conventional compressor. The compressed air is heated in a first combustion chamber (e.g. via an EV combustor). After the addition of a first part, e.g. about 60% of the fuel, the combustion gas partially expands through the first turbine stage. The remaining fuel is added in a second combustion chamber (e.g. via an SEV combustor), where the gas is again heated to the maximum turbine inlet temperature. Final expansion follows in the subsequent turbine stages.

In so-called SEV-burners, e.g. sequential environmentally friendly v-shaped burners, generally of the type as for instance described in U.S. Pat. No. 5,626,017, regions are found, where self-ignition of the fuel occurs and no external ignition source for flame propagation is required. Spontaneous ignition delay is defined as the time interval between the creation of a combustible mixture, achieved by injecting fuel into air at high temperatures, and the onset of a flame via auto-ignition. A reheat combustion system, such as the SEV-combustion chamber, also called SEV-combustor, can be designed to use the self-ignition effect. Combustor inlet temperatures of around 1000 degrees Celsius and higher are commonly selected.

For the injection of gaseous and liquid fuels into the mixing section of such a premixing burner, typically fuel lances are used, which extend into the mixing section of the burner and inject the fuel(s) into the oxidizing stream (22) of combustion air flowing around and past the fuel lance. One of the challenges here is the correct distribution of the fuel and obtaining the correct ratio of fuel and oxidizing medium.

SEV-burners are currently designed for operation on natural gas and oil. The fuel is injected radially from a fuel lance into the oxidizing stream and interacts with the vortex pairs created by vortex generators, as for instance described in U.S. Pat. No. 5,626,017, thereby resulting in adequate mixing prior to combustion in the combustion chamber downstream of the mixing section.

SUMMARY

The present disclosure deals with a method for fuel injection in a sequential combustion system having: a first combustion chamber and, downstream thereof, a second combustion chamber. In between the first and second combustion chambers is a premixing chamber having a longitudinal axis that includes at least one vortex generator. Located downstream of the vortex generator is a mixing section and a fuel lance having a vertical portion and a horizontal portion parallel to the longitudinal axis provided within said mixing section. The fuel has a calorific value of 5-20 MJ/kg. In the mixing section, the fuel and the oxidizing stream coming from the first combustion chamber are premixed to a combustible mixture. The method includes injecting the fuel in such a way that the residence time of the fuel in the mixing section is reduced in comparison with a radial injection of the fuel from the horizontal portion of the fuel lance.

BRIEF DESCRIPTION OF THE DRAWINGS

In the accompanying drawings preferred embodiments of the invention are shown in which:

FIG. 5*a*.) shows fuel jets being injected without any tangential component with respect to the periphery of the fuel lance; FIG. 5*b*.) shows fuel jets being injected from the fuel lance tangentially with respect to the periphery of the fuel lance tube in swirl direction; FIG. 5*c*.) shows fuel jets being injected from the fuel lance tangentially with respect to the periphery of the fuel lance tube against swirl direction.

DETAILED DESCRIPTION OF THE PREFERRED EMBODIMENTS

Introduction to the Embodiments

Figure 1:
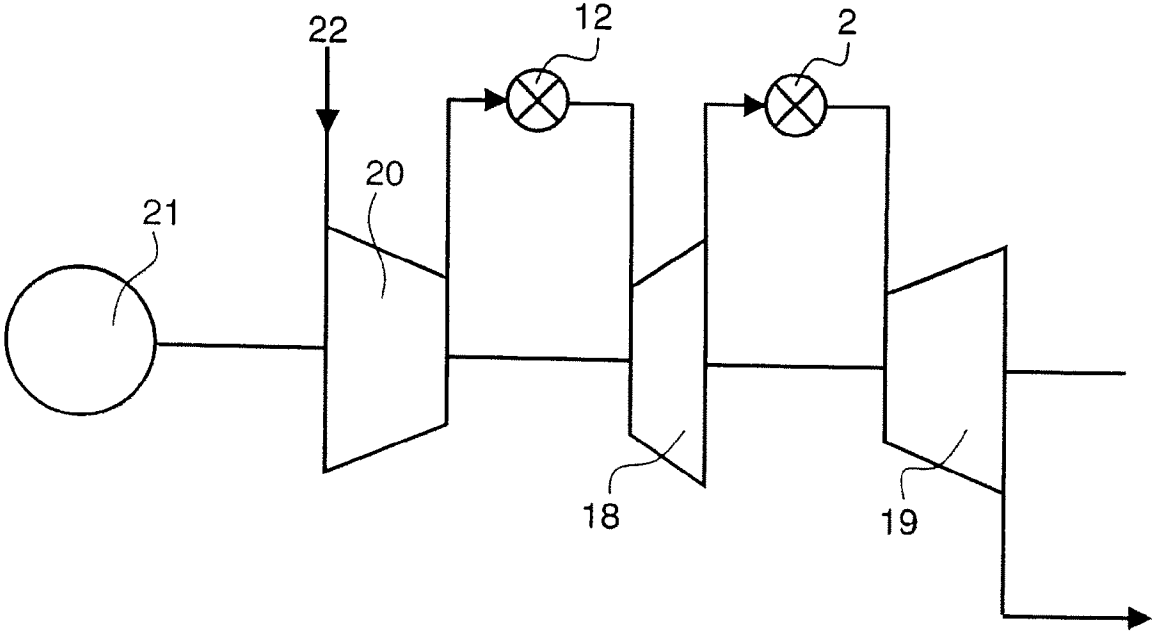
FIG. 1 shows a schematic view of a sequential combustion cycle with two combustion chambers.

Currently, burners for the second stage of sequential combustion are designed for operation on natural gas and oil. In light of the above mentioned problems, the fuel injection configuration should be altered for the use of MBtu-fuels in order to take into account their different fuel properties, such as smaller ignition delay time, higher adiabatic flame temperatures, lower density, etc.

The objective goals underlying the present invention is therefore to provide an improved stable and safe method for the injection of MBtu fuel for the combustion in such second stage burners or premixing chambers as known for example from U.S. Pat. No. 5,626,017.

In other words, the present invention pursues the purpose by providing a method for fuel injection in a sequential combustion system comprising a first combustion chamber and downstream thereof a second combustion chamber, in between which at least one vortex generator (e.g. swirl generator as disclosed in U.S. Pat. No. 5,626,017) is located, as well as downstream of the vortex generator a premixing chamber having a longitudinal axis, with a mixing section and a fuel lance having a vertical portion and a horizontal portion, extending into said mixing section. Said fuel lance can for instance be of the type disclosed in EP 0 638 769 A2, or any other fuel lance type known in the state of the art. The fuel to be injected, preferably a MBtu-fuel, has a calorific value of 5,000-20,000 kJ/kg, preferably 7,000-17,000 kJ/kg, more preferably 10,000-15,000 kJ/kg. In said premixing chamber, or in its mixing section, respectively, the fuel and the oxidizing stream (combustion air) coming from the first combustion chamber are premixed to a combustible mixture. The fuel is injected in such a way that the residence time of the fuel in the premixing chamber is reduced in comparison with a radial injection of the fuel from the horizontal portion of the fuel lance. Thereby, the creation of the combustible mixture and its spontaneous ignition is postponed.

Experience from lean-premixed burner development indicates that the SEV burner has to be redesigned in order to cope with the radically different combustion properties of MBtu (MBtu fuel input=Million Btu; 1 Btu=amount of energy required to raise one pound of water 1° F.) such as H-richness, lower ignition delay time, higher adiabatic flame temperature, higher flame speed, etc. It is also necessary to cope with the much higher volumetric fuel flow rates caused by densities up to 10 times smaller than for natural gas. Application of existing burner designs to such fuels results in high emissions and safety problems. The MBtu fuels, which are gaseous, cannot be injected radially into the oncoming oxidizing stream because the blockage effect of the fuel jets (i.e. stagnation zone upstream of jet, where oncoming air stagnates) increases local residence times of the fuel and promotes self ignition. Furthermore, the shear stresses are highest for a jet perpendicular to the main flow. The resulting turbulence may be high enough to permit upstream propagation of the flame. It is important to avoid recirculation zones around the fuel lance, which might be filled with fuel-containing gas and could lead to flashback or thermo-acoustic oscillations. When injecting the fuel, it should be ensured, that the combustible mixture is not combusted prematurely.

In a first preferred embodiment of the present invention, the fuel contains H2 or any other equivalently highly reactive gas. A gas with a substantial hydrogen content has an associated low ignition temperature and high flame velocity, and therefore is highly reactive. Preferably the fuel is synthesis gas (or Syngas), which per se is known as having a high hydrogen content, or any other synthetic flammable gas, as e.g. generated by the oxidation of coal, biomass or other fuels. Syngas is a gas mixture containing varying amounts of carbon monoxide, carbon dioxide, CH4 (main components are CO and H2 with some inert like CO2 H2O or N2 and some methane, propane etc.) etc. and hydrogen generated by the gasification of a carbon containing fuel to a gaseous product with a heating value. Examples include steam reforming of natural gas or liquid hydrocarbons to produce hydrogen, the gasification of coal and in some types of waste-to-energy gasification facilities. The name comes from their use as intermediates in creating synthetic natural gas (SNG). This kind of fuel has rather different characteristics from natural gas concerning the calorific value, the density and the combustion properties as e.g. volumetric flow, flame velocity and ignition delay time. Syngas typically has less than half the energy density of natural gas. In a gas turbine with sequential combustion, significant adjustments are thus necessary in order to cope with these differences.

According to a further embodiment of the present invention, at least a portion of the fuel is injected from the fuel lance with an axial component greater than zero in flow direction with reference to the longitudinal axis of the premixing chamber. Preferably, the radial component of the fuel jet is also greater than zero. The injection holes can be inclined such that the angle of injection a of fuel from the horizontal portion of the fuel lance between the fuel jet and the longitudinal axis is between 10 and 85 degrees, preferably between 20 and 80 degrees, more preferably between 30 and 50 degrees, most preferably between 40 and 60 degrees with respect to the longitudinal axis of the premixing chamber. Preferably, the fuel jet has an axial as well as a radial component. Fully radial injection results in excessive fuel jet/air interactions in the mixing section and thereby results in a high risk for premature self-ignition, whereas a fully axial injection leads to bad mixing of fuel and air.

Another measure for improving burner safety is to re-shape the downstream side of the fuel lance. Reducing the bluffness of the downstream side of the lance diminishes, or even eliminates, the recirculation zone that currently exists behind this device (fuel trapped in such a recirculation zone has a very high residence time, greater than the ignition delay time).

An alternative approach achieving the same or similar or equivalent effect, e.g. the reduction of residence time of fuel in the premixing chamber or the mixing section, respectively, would be, to inject at least a portion (or all) of the MBtu fuel into the mixing section further downstream of the fuel lance, nearer to the burner exit, via a series of injection holes in one or more additional injection devices (using considerations stated above, preferably with a fuel jet inclination comprising both axial and radial components) distributed along the circumference of the mixing section tube on its periphery. For instance, the MBtu fuel can be supplied via a device or plenum located downstream of the fuel lance near the entrance to the second combustion chamber and thereby closer to the second combustion chamber than to the at least one vortex generator, which is located upstream of the fuel lance. Preferably, the combustible mixture of air and fuel is created close to the entrance to the combustion chamber to minimise residence time. As well as minimizing alterations of the standard fuel lance, this method also reduces the residence time of the MBtu fuel in the mixing section, thereby diminishing the risk of flashback. Preferably, also the additional injection devices have injection holes inclined in a way to enable fuel jets with axial components.

Preferably but not imperatively, the fuel lance contains more than 4 injection holes. More preferably, it injects at least 8, preferably at least 16 fuel jets into the premixing chamber The diameter of each injection hole is preferably reduced (while e.g. the total content of fuel to be injected remains constant). This results in a greater number of fuel jets with smaller diameters dispersed over the area of the mixing section, which again results in an adapted mixing of fuel with oxidizing medium.

Furthermore, it can be of advantage, if the fuel is injected not only with a radial and an axial component with respect to the longitudinal axis of the fuel lance, but also with a tangential component with respect to the periphery of the cylindrical fuel lance tube. Depending on whether the tangential injection of the fuel is in the direction of swirl created in the oxidizing stream by the vortex generator(s) or against said swirl direction, different mixing properties can be achieved.

According to another preferred embodiment, whether or not the fuel jet has an axial component or the number of injection holes is increased or whether or not one or more additional injection devices are provided upstream of the fuel lance, air and/or N2 and/or steam, preferably a non-oxidizing medium or inert constituent such as N2 or steam in order to prevent back firing, can be provided as a buffer between the injected fuel and the oxidizing stream. Such a "dilution" or shielding of the gaseous fuel improves the stability of combustion and contributes to the reduction of flashback typical for high-H2-concentrations. Preferably the buffer is or builds a circumferential shield around the fuel jet. The carrier-/shielding properties of N2 or steam permit greater radial fuel penetration depths, which results in improved fuel distribution. The carrier provides an inert buffer between fuel jet and incoming combustion air, such that there is initially no direct contact between fuel and air (oxygen) in the stagnation region on the upstream side of the jet. Steam is even more kinetically-neutralising than N2. Furthermore, its greater density promotes even greater fuel jet penetration. This technique can also be employed with more axially-inclined jets, so as to firstly prevent contact between oxidant and fuel prior to a certain level of fuel spreading, and secondly to utilize the momentum of the carrier to increase the fuel penetration and thus improve fuel distribution throughout the burner.

For this purpose, N2 and/or steam can also be premixed with the fuel before injection, or can be injected separately concomitantly with the fuel or in an alternating sequence. The air and/or N2 and/or steam, preferably a non-oxidizing medium such as N2 or steam, can be injected from the fuel lance itself, together or separate from the fuel, or from one or more injection devices downstream of the fuel lance.

As already mentioned above, it can be of advantage to inject at least some of the fuel (with or without carrier air, N2 or steam) from the downstream side of the fuel lance. The fuel momentum could serve to prevent the formation of any recirculation regions. If desirable, the same effect could be achieved by injection of only air or N2 or steam.

According to another preferred embodiment, two different fuel types are injected, preferably from different injecting devices or different injection locations, into the premixing chamber. A second fuel type (e.g. natural gas or oil) can serve as a backup or startup. Of course, at least one of the two fuel types is an MBtu-fuel. If the two fuel types are injected from at least two different injection devices or locations, at least one fuel type advantageously is injected with an axial component with respect to the longitudinal axis of the premixing chamber.

In the sequential combustion system, it is advantageous, if the gas is at least partially expanded in a first expansion stage between the first combustion chamber and the second combustion chamber. In a gas turbine, said expansion preferably is achieved by a series of guide-blades and moving-blades. Preferably, a first expansion stage is provided downstream of the first combustion chamber and a second expansion stage downstream of the second combustion chamber.

Alternatively, it may be of advantage if a portion of Mbtu fuel is injected axially via the trailing edge of the vortex generators, and the remainder of the fuel via the fuel lance (using any of above concepts) and/or one or more further downstream injection devices. Apart from improving overall mixing and burner safety, this method frees up valuable space in the main fuel lance, thereby permitting a second fuel (e.g. natural gas or oil) to be used as backup (or startup). In an extreme case of this alternative, all MBtu fuel is injected via the vortex generators such that the lance remains in its original guise and therefore does not affect standard natural gas and oil operation (i.e. tri-fuel burner).

Further embodiments of the present invention are outlined in the dependent claims.

Detailed Description

Referring to the drawings, which are for the purpose of illustrating the present preferred embodiments of the invention and not for the purpose of limiting the same, FIG. 1 shows a schematic view of a sequential combustion cycle with two combustion chambers or burners, respectively. The depicted arrangement can for instance make up a gas-turbine group having sequential combustion, as for example having two combustion chambers of which one is coupled with a high pressure turbine and the other one with a low pressure turbine. Alternative arrangements of the units are possible. In FIG. 1, a generator 21 is provided, which is driven in the sequential cycle on one shaft. Air 22 is compressed in a compressor 20 before being introduced into a first combustion chamber 12, followed further downstream by a first expansion stage 18. After partial expansion, e.g. in a high pressure turbine, the air is introduced into a second combustion chamber 2. Said second combustion chamber 2 can for instance be a SEV-burner, according to one preferred embodiment of the invention. Preferably, said burner takes advantage of self-ignition downstream of the premixing chamber 4, where the air has very high temperatures. A second expansion stage 19 follows downstream of said second combustion chamber 2.

Figure 2:
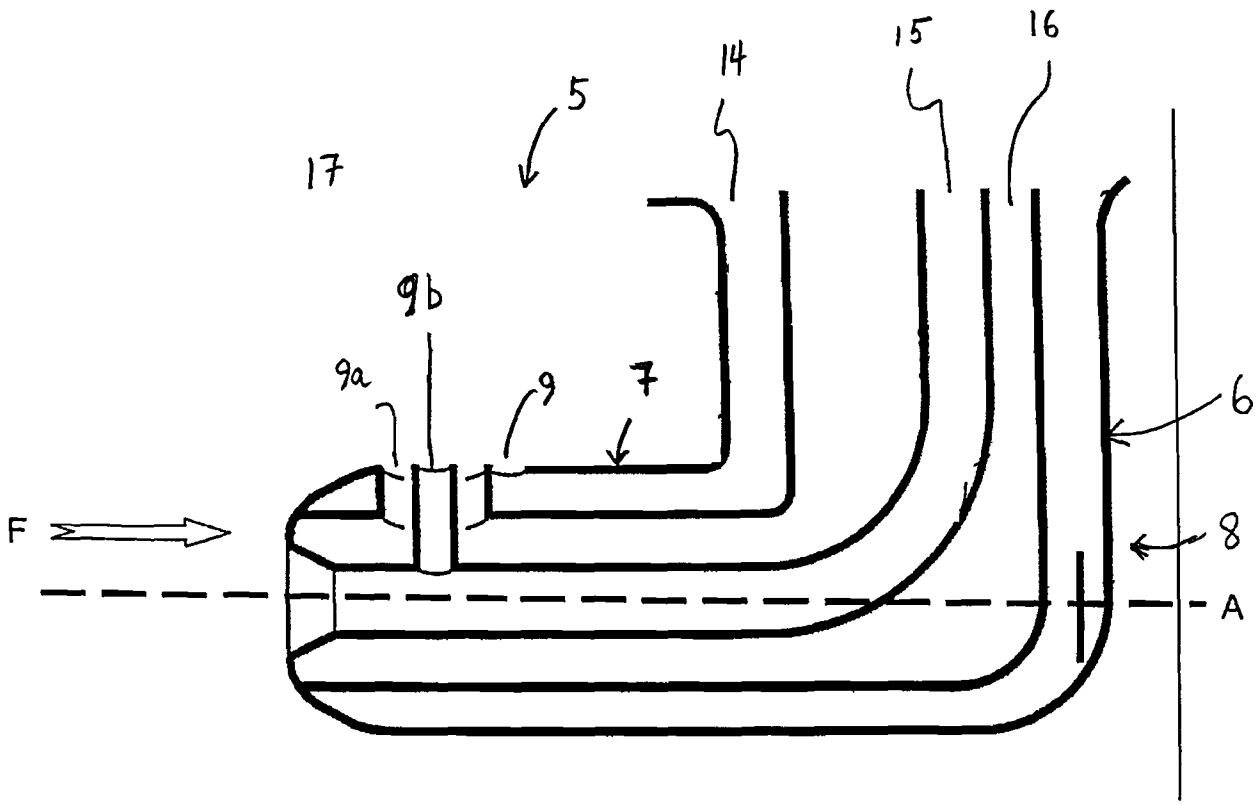
FIG. 2 shows a section through the current design of a fuel lance operating on natural gas and oil used for injection into a mixing section of a premixing chamber.

FIG. 2 shows a section through of a state of the art fuel lance 5 (as e.g. in a more fuel burner). Said fuel lance 5 can be adapted to inject fuel such as oil and/or natural gas, and possibly carrier air in addition to the fuel. The fuel lance 5 shown has at least one duct for oil 14, at least one duct for natural gas 15 and at least one duct for air 16. Said fuel lance has a vertical portion 6 and a horizontal portion 7. The horizontal portion 7 of a length L3, which is suspended by the vertical portion 6 of a length L2 into the mixing section 17, preferably is provided with injection holes 9 for liquid fuel along a circular line around its circumference. Said injection holes 9 are generally provided in a downstream portion of the horizontal portion 7 of the fuel lance 5, preferably in the quarter of the length L3 which is located closest to the second combustion chamber 2. The liquid fuel is injected radially, as described e.g. in EP 0 638 769 A2. Typically about 3-4 injection holes are provided, preferably located around the circumference in 90 or 120 degree angles from each other. In such burners, the downstream side 8 at the tip of the fuel lance 5 is closed, i.e. it contains no injection holes 9. Therefore, the depicted fuel lance 5 cannot inject fuel in an axial direction with respect to the longitudinal axis A of the premixing chamber 4, but only radially into the oxidizing stream 22 through the injection holes 9 depicted. SEV-burners are currently designed for operation on natural gas and oil. Besides ducts 14 for oil, the depicted state of the art fuel lance 5 is equipped with ducts 15 for natural gas and ducts 16 for air. Besides injection holes 9 for liquid fuel, injection holes 9*a*, 9*b* are also provided for air and gas (e.g. natural gas) in the fuel lance 5 of FIG. 2, said air and gas are injected into the combustion air radially. However, the fuel lance need not necessarily be equipped for three different components. The section of FIG. 2 extends through the injection hole 9 for oil located at the top of the horizontal portion 7 of the fuel lance 5 as well as through the injection hole 9*a* for air and the injection hole 9*b* for gas. According to the figure, no injection hole 9 is located 180 degrees from the top injection hole 9 shown. Therefore, FIG. 2 shows a fuel lance 5 with 3 injection holes 9, such that not every injection hole 9 has a counterpart injection hole 9 on the opposite side of the circumference of the fuel lance cylinder.

Figure 3:
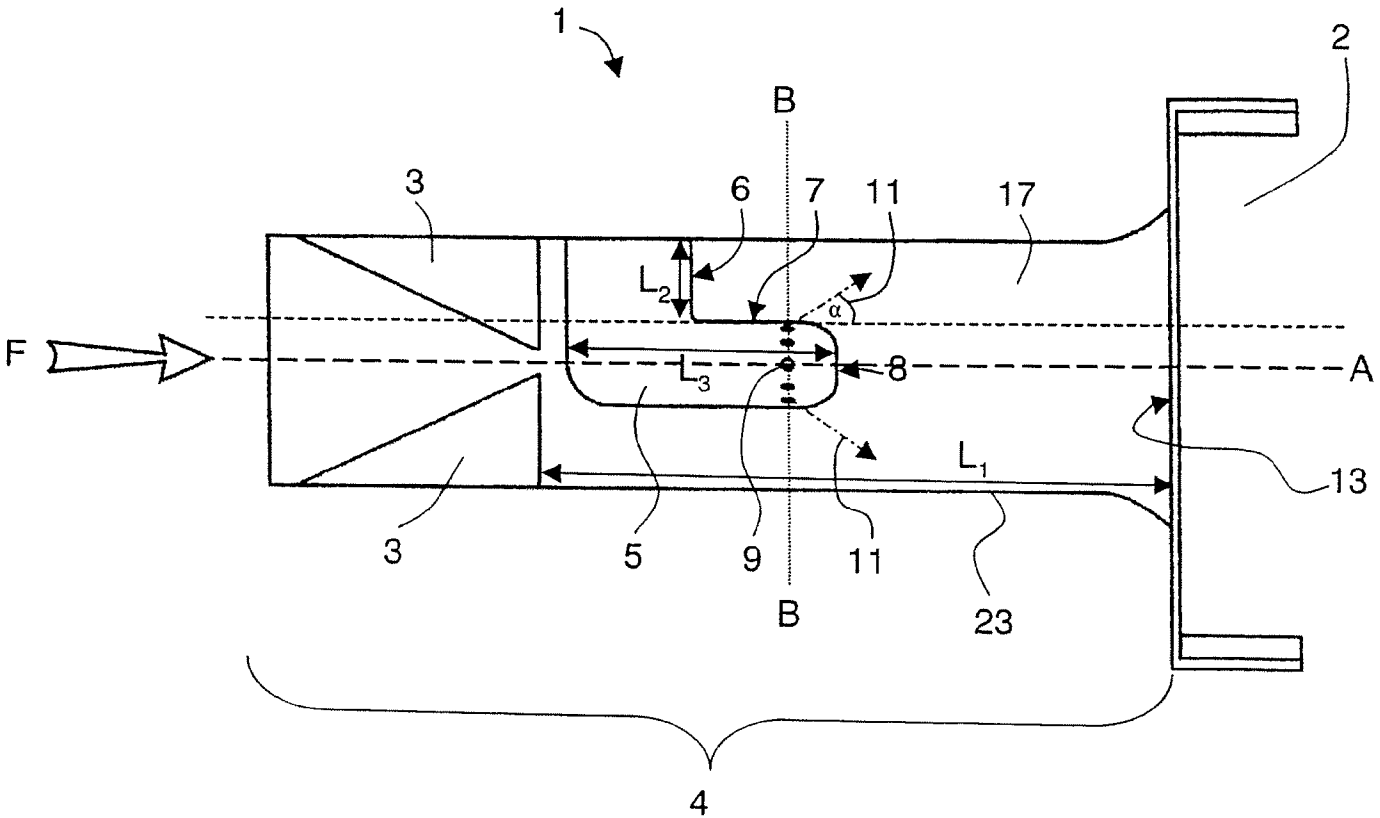
FIG. 3 schematically shows, in a section through an SEV-burner, the relative positions of the fuel lance, vortex generators and combustion chamber.

FIG. 3 shows a section through a part of a gas turbine group, and specifically the part including the sequential combustion in an SEV-burner 1 according to one preferred embodiment of the invention. Said SEV-burner according to one of the embodiments of the invention is designed for the injection of MBtu-fuels. In such a gas turbine group, hot gases are initially generated in a high-pressure first combustion chamber 12. Downstream thereof operates a first turbine 18, preferably a high pressure turbine, in which the hot gases undergo partial expansion. From left to right in the figure, coming from a first burner, e.g. an EV-burner, in other words from a first combustion chamber 12 thereof, followed by a first expansion stage 18 (e.g. high pressure turbine), the oxidizing stream 22 (combustion air) enters the second combustion chamber 2 in a flow direction F. The inflow zone at the entrance to the premixing chamber 4, which is formed as a generally rectangular duct serving as a flow passage for the oxidizing stream 22, is equipped on the inside and in the peripheral direction of the duct wall with at least one vortex generator 3, preferably two or several vortex generators 3, as depicted, or more (as e.g. described in U.S. Pat. No. 5,626,017, the contents of which are incorporated into this application by reference with respect to the vortex generators), which create turbulences in the incoming air, followed by a mixing section 17 downstream in flow direction F, into which fuel jets 11 are injected from at least one fuel lance 5. The horizontal portion 7 of said fuel lance 5, generally formed as a tube with a cylindrical wall 23, is disposed in the direction of flow F of the oxidizing stream (of hot gas) 22 parallel to the longitudinal axis A of the cylindrical or rectangular premixing chamber 4 and its horizontal portion 7 preferably disposed centrally therein. In other words, the horizontal portion 7 is disposed from the periphery of the duct of the premixing chamber 4 at a distance equal to the length L2 of the vertical portion 6 of the fuel lance 5. The fuel lance 5 extends into the mixing section 17 with its vertical portion 6 suspended radially with respect to the radius of the mixing section's cylindrical form or duct. The length L3 of the horizontal portion 7 of the fuel lance 5 is about half the length L1 of the mixing section 17 or less.

The downstream side 8 of the horizontal portion 7 makes up the free end of the fuel lance 5 facing the second combustion chamber 2. Said free end of the horizontal portion 7 of the fuel lance 5 can have a frusto-conical shape. This reduction of the bluffness of the downstream side of the fuel lance 5 contributes to a reduction or elimination of the recirculation zone existing behind the lance. Fuel trapped in such a recirculation zone has a very high residence time, potentially greater than the ignition delay time.

Said two vortex generators 3 (swirl generators) are illustrated as two wedges in the figure. The hot gases entering the premixing chamber 4 are swirled by the vortex generators 3 such that mixing is possible and recirculation areas are diminished or eliminated in the following mixing section 17. The resulting swirl flow promotes homogenization of the mixture of combustion air and fuel. The mixing section 17, being generally formed as a cylindrical or rectangular duct or tube, has a length L1 of 100 mm to 350 mm, preferably 150 mm to 250 mm and a diameter of 100 mm to 200 mm. The fuel injected by the fuel lance 5 into the hot gases that enter the premixing chamber 4 as an oxidizing stream 22 initiates mixing and subsequent self-ignition. Said self-ignition is triggered at specific mixing ratios and gas temperatures depending on the type of fuel used. For instance, when MBtu-fuels are used, self-ignition is triggered at temperatures around 800-850 degrees Celsius, whereas flashback temperature depends on H2 content. For the above mentioned combustion chamber the main parameter which controls flashback is ignition delay time, which goes down with increasing temperature.

Figure 4:
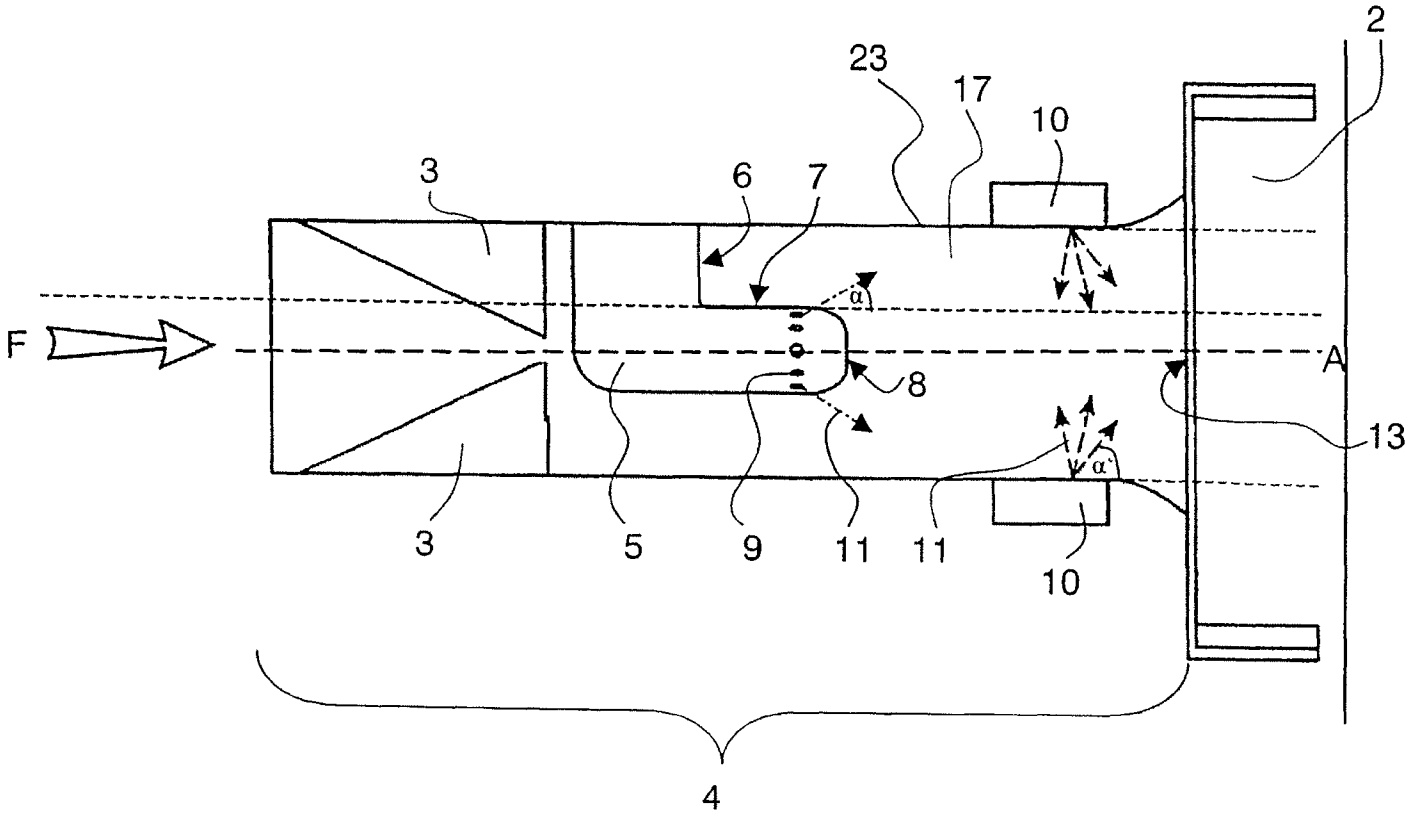
FIG. 4 shows, in a schematic view, a section through an SEV-burner, in which the injection method according to one of the preferred embodiments of the present invention can be exercised, according to a preferred embodiment of the present invention. The MBtu fuel plenum located between the fuel lance and the combustion chamber as an additional fuel injection device.

A mixing zone is established in the mixing section 17 around the horizontal portion 7 of the fuel lance 5 and downstream of the fuel lance 5 before the entrance 13 into the second combustion chamber 2, if further injection devices 10, as depicted in FIG. 4, are disposed on the periphery of the mixing section 17. Preferably, the mixing zone is located as far downstream as possible, so that the likelihood of self-ignition on account of a long dwell time and hence the probability of flashback into the mixing zone is reduced.

The injection holes 9 are located on a circle line around the circumference of the generally hollow cylindrical horizontal portion 7 of the fuel lance 5. In the state of the art, the injection holes 9 are arranged in a way that the fuel is injected fully radially with respect to the axis of the cylindrical horizontal portion 7 of the fuel lance 5 and/or the longitudinal axis A of the generally cylindrically shaped mixing section 17 or the premixing chamber 4. However, according to a preferred embodiment of the invention, the fuel is injected into the oxidizing stream 22 with a significant axial component in flow direction F with respect to the longitudinal axis A of the premixing chamber 4.

Said injection holes 9 can have a diameter of about 1 mm to about 10 mm. In the state of the art, the fuel lance 5 has at most 4 injection holes 9. However, the fuel lance can be equipped with any number of holes between 2 and 32, possibly even more. In order to improve the mixing properties, more than 4, for instance 8, or even more, e.g. up to 16 or even up to 32 injection holes 9 can be provided on the fuel lance 5. By increasing the number of injection holes 9, with a constant amount of fuel to be injected, the diameter of each injection hole 9 can be reduced, which leads to a more directed fuel jet 11 coming from each injection hole 9 and thereby to a greater injection pressure. By achieving a more directed fuel jet 11, the fuel is distributed further downstream of the fuel lance 5, thereby shifting the ignition zone to a position further downstream and closer to the entrance 13 of the second combustion chamber 2. This is desired as the residence time of the fuel in the premixing chamber 4 is thereby reduced. By increasing the number of injection holes 9 it must be noted that this measure can cause a smaller fuel penetration and consequently as a result, worse mixing.

As depicted in FIG. 4, according to another preferred embodiment of the invention, the residence time of the fuel in the premixing chamber 4 can further be reduced by adding further injection devices 10 downstream of the fuel lance 5 in the premixing chamber 4. By injection of a portion of the fuel further downstream in the mixing section 17, the mixing zone is shifted further downstream and closer to the second combustion chamber 2. Preferably the fuel (of one or more types) is injected from both the fuel lance 5 and at least one further injection device 10. In FIG. 4, only one additional circumferential injection device 10 is shown. However, more than one additional device is possible. Such additional injection devices 10 can be located at various positions along the periphery of the mixing section 17 and at different positions distributed along its length L1. Each additional injection device 10 can have one or more injection holes 9, which are adapted to inject the fuel with a radial and an axial component, at an angle $\alpha'$ of about 20 to 120 degrees, preferably 5-80 degrees, more preferably 30-70 degrees and most preferably 40-60 degrees.

Injection angle $\alpha'$ is defined as the angle between the fuel jet injection direction and the direction of the inner surface of the tube or cylindrical wall 23, respectively, of the mixing section 17 in an axial plane thereof. Said angle $\alpha'$ can have any value of zero or greater and at the most 180, preferably 90 degrees. The injection angle $\alpha$, $\alpha'$, whether from the fuel lance 5 or an additional injection device downstream of the fuel lance, depends on different factors, such as the type of fuel used, whether or not a buffer such as N2 or steam is employed, on the gas temperature etc. It is possible to provide injection holes 9 directed at different injection angles $\alpha'$ in a single injection device 10, such that the fuel is injected into different directions simultaneously. The fuel jets 11 from the additional device(s) 10 can also have tangential components as discussed in FIGS. 5*a*.)-*c*.)

Figure 5:
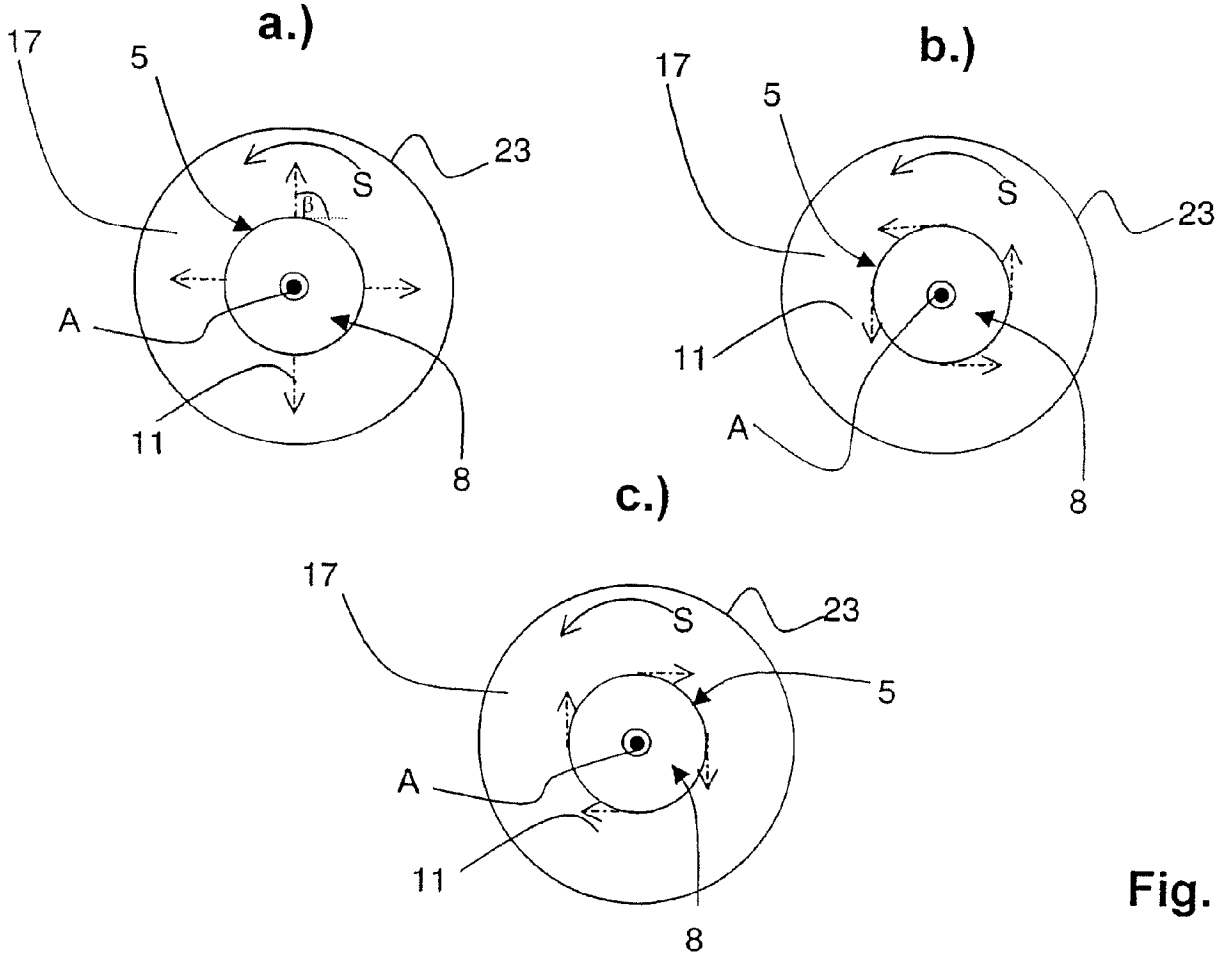
FIG. 5 schematically shows a section through line B-B of FIG. 3.

FIG. 5 shows a section through line B-B of the fuel lance 5 of FIG. 3. Said section extends through the injection holes 9 for fuel, i.e. through the circle line described by the injection holes around the circumference of the fuel lance 5. Looking into the mixing section 17 with its cylindrical wall 23 onto the downstream side 8 of the fuel lance 5 from the second combustion chamber 2 (not shown in FIG. 5), the viewer faces the oncoming oxidizing stream 22. In FIG. 5*a*.), the fuel jets 11 are injected into the mixing section 17 with a radial and axial component with respect to the longitudinal axis A of the premixing chamber 4, if viewed along the longitudinal axis A, but not tangentially with respect to the circumference of the cylindrical periphery of the fuel lance 5. The fuel jets 11 are injected along an axial plane. In other words, the injection direction of the fuel jets 11 is not adjusted to, i.e. doesn't follow the swirl created in the oxidizing stream 22 by the vortex generators, indicated with arrow S. If an injection direction according to FIG. 5*a*.) is chosen, the fuel is injected along an axial plane through the injection hole 9. However, it is possible to choose an injection direction (i.e. to adjust the injection device in the fuel lance or the injection holes 9), which allows the fuel to be injected in a direction tilted out of the axial plane (see FIGS. 5*b*.) and 5*c*.).

In FIG. 5*a*.), if viewed along the longitudinal axis A from the second combustion chamber 2 toward the fuel lance 5, one would see the fuel jets 11 being injected radially, whereby they preferably also have an axial component in the flow direction F with respect to the longitudinal axis A of the premixing chamber 4. In the case of FIG. 5*a*.), the tangential component is zero.

In FIGS. 5*b*.) and 5*c*.), the injection of the fuel jets is adjusted to, i.e. follow, the swirl of the oxidizing stream 22. The injection holes 9 are arranged in a way that the fuel jets 11 are injected into the mixing section 17 also with a tangential component greater than zero with respect to the circumference of the cylindrical fuel lance tube. In FIG. 5*b*.), the tangential injection direction follows the swirl direction S, whereas in FIG. 5*c*.), the tangential injection direction is opposite to the swirl direction S. After injection, the fuel jets 11 are then diverted to follow the swirl direction S. Depending on whether the fuel is injected tangentially in swirl direction S or against it, different mixing properties are achieved. Intermediate injection with a tangential component is possible with angles β of 0-180 degrees, preferably 30-150 degrees, even more preferably 60-180 degrees Said angle β is defined as the angle between the injection direction and a tangential perpendicular to the radius of the cylindrical horizontal portion 7 of the fuel lance 5 in a plane perpendicular to the longitudinal axis A of the premixing chamber 4.

LIST OF REFERENCE NUMERALS

1 SEV burner
2 Second combustion chamber
3 Vortex generator
4 Premixing chamber
5 Fuel lance
6 Vertical portion of 5
7 Horizontal portion of 5
8 Downstream side of 5
9 Injection hole for fuel
9*a* Injection hole for air
9*b* Injection hole for gas
10 Injection device
11 Fuel jet
12 First combustion chamber
13 Entrance to combustion chamber
14 Duct in 5 for oil
15 Duct in 5 for natural gas
16 Duct in 5 for carrier air
17 Mixing section
18 First expansion stage
19 Second expansion stage
20 Compressor
21 Generator
22 Combustion air, oxidizing stream
23 Cylindrical wall of 17
A Longitudinal axis of 4
F Flow direction of oxidizing air stream
L1 Length of 17
L2 Length of 6
L3 Length of 7
S Swirl direction of 22
α injection angle in 5
α' injection angle in 10
β angle of tangential component
B-B section through 5

What is claimed is:

1. Method for fuel injection in a sequential combustion system comprising a first combustion chamber and, downstream thereof, a second combustion chamber, in between which a premixing chamber having a longitudinal axis comprising at least one vortex generator, as well as downstream of the vortex generator a mixing section and a fuel lance having a vertical portion and a horizontal portion parallel to the longitudinal axis provided within said mixing section is located, wherein the fuel has a calorific value of 5-20MJ/kg and wherein in said mixing section the fuel and an oxidizing stream coming from the first combustion chamber are premixed to a combustible mixture, the method comprising:

injecting the fuel in such a way that the residence time of the fuel in the mixing section is reduced in comparison with a radial injection of the fuel from the horizontal portion of the fuel lance, wherein an angle between a fuel jet injected from the horizontal portion of the fuel lance and the longitudinal axis is between 10 and 85 degrees, with respect to the longitudinal axis of the premixing chamber, wherein hot gases entering the premixing chamber are swirled upstream of the fuel lance by the at least one vortex generator and wherein the mixing section is situated downstream of the fuel lance and upstream of the combustion chamber respective of a cross-sectional jump of the combustion chamber.

2. Method for fuel injection according to claim 1, wherein the fuel contains H2.

3. Method for fuel injection according to claim 1, wherein the fuel has a calorific value of 7,000-17,000 kJ/kg.

4. Method for fuel injection according to claim 1, wherein at least a portion of the fuel is injected from the fuel lance with an axial component in flow direction with reference to the longitudinal axis of the premixing chamber.

5. Method for fuel injection according to claim 1, wherein a portion of the fuel is injected into the mixing section from at least one injection device downstream of the fuel lance.

6. Method for fuel injection according to claim 5, wherein said injection device is located in a portion of the mixing section which is located closer to the second combustion chamber than to the at least one vortex generator, said portion having a length of one third or less of the length of the mixing section.

7. Method for fuel injection according to claim 1, wherein the fuel lance injects at least one fuel jet.

8. Method for fuel injection according to claim 7, wherein the fuel lance injects at least 4, or at least 8 or at least 16 fuel jets.

9. Method for fuel injection according to claim 1, wherein N2 and/or steam is provided as a buffer between the injected fuel and the oxidizing stream, preferentially as a circumferential shielding of a fuel jet.

10. Method for fuel injection according to claim 1, wherein N2 and/or steam is premixed with the fuel before injection.

11. Method for fuel injection according to claim 1, wherein air and/or N2 and/or steam is injected from an injection device downstream of the fuel lance.

12. Method for fuel injection according to claim 1, wherein two different fuel types are injected, preferably from different injecting devices, into the premixing chamber.

13. Method for fuel injection according to claim 12, wherein two different fuel types are injected from at least two different injection devices, wherein at least one fuel type is injected with an axial component with respect to the longitudinal axis of the premixing chamber.

14. Method for fuel injection according to claim 1, wherein the gas is at least partially expanded in an expansion stage between the first combustion chamber and the second combustion chamber.

15. Method for fuel injection according to claim 1, wherein fuel is injected into the mixing section of a SEV-burner.

16. Method for fuel injection according to claim 1, wherein the fuel has a calorific value of 10'000-15'000 kJ/kg.

17. Method for fuel injection according to claim 1, wherein an angle between a fuel jet injected from the horizontal portion of the fuel lance and the longitudinal axis is between 20 and 80 degrees, with respect to the longitudinal axis of the premixing.

18. Method for fuel injection according to claim 1, wherein an angle between a fuel jet injected from the horizontal portion of the fuel lance and the longitudinal axis is between 30 and 70 degrees with respect to the longitudinal axis of the premixing chamber.

19. Method for fuel injection according to claim 1, wherein an angle between a fuel jet injected from the horizontal portion of the fuel lance and the longitudinal axis is between 40 and 60 degrees with respect to the longitudinal axis of the premixing chamber.

20. Method for fuel injection according to claim 5, wherein said injection device is located in a portion of the mixing section which is located closer to the second combustion chamber than to the at least one vortex generator, said portion having a length of one fourth or less of the length of the mixing section.

* * * * *